US006116940A

United States Patent [19]

Bertens et al.

[11] Patent Number: 6,116,940

[45] Date of Patent: Sep. 12, 2000

[54] COUPLER FOR ELECTRICAL CONNECTORS

[75] Inventors: Aloysius Antonius Bertens, Vught; Roland Tristan De Blieck; Johannes Marcelus Broeksteeg, both of Oss, all of Netherlands

[73] Assignee: The Whitaker Corporation, Wilmington, Del.

[21] Appl. No.: 09/065,022

[22] PCT Filed: Nov. 4, 1996

[86] PCT No.: PCT/IB96/01181

§ 371 Date: Apr. 20, 1998

§ 102(e) Date: Apr. 20, 1998

[87] PCT Pub. No.: WO97/17743

PCT Pub. Date: May 15, 1997

[30] Foreign Application Priority Data

Nov. 6, 1995 [GB] United Kingdom ..... 9522711
Aug. 28, 1996 [GB] United Kingdom ..... 9617967

[51] Int. Cl.[7] ..... H01R 13/627

[52] U.S. Cl. ..... 439/357; 439/247

[58] Field of Search ..... 439/64, 247, 248, 439/374, 378, 350, 357

[56] References Cited

U.S. PATENT DOCUMENTS 4,895,521 1/1990 Grabbe ..... 439/63
5,041,003 8/1991 Smith et al. ..... 439/259
5,228,861 7/1993 Grabbe ..... 439/66
5,324,206 6/1994 Conroy-Wass ..... 439/77

FOREIGN PATENT DOCUMENTS 0 274 534-A1 7/1988 European Pat. Off. ..... H01R 23/68
0 428 359-A1 5/1991 European Pat. Off. ..... H01R 23/70
0 430 170-A2 6/1991 European Pat. Off. ..... G02B 6/38
WO 94/24594 10/1994 WIPO ..... G02B 6/38

*Primary Examiner*—Khiem Nguyen

[57] ABSTRACT

An electrical connector for interconnecting a first circuit board to a second circuit board that has a connector housing attachable to the first board, including a base plate in the vicinity of the first board with a plurality of openings for providing access to contact members on the first board; a floating terminal block cooperating with a plurality of individually resilient contacts that rely on normal forces to establish an electrical, flexible conductors extending between the base plate and the electrical contacts to establish an electrical connection between the first board and the second board; a biasing member positioned relative to the housing and the terminal block so that the terminal block, and the plurality of individually resilient contact elements are biased away from the housing, the biasing member exerting a spring force on the terminal block such that a mating force is established between the contacts and the second circuit board is established; and, a coupler for maintaining the relative positions connector to the mating circuit board.

12 Claims, 7 Drawing Sheets

COUPLER FOR ELECTRICAL CONNECTORS

With respect to the International Application as published on May 15, 1997:

BACKGROUND OF THE INVENTION

1. Field of the Invention

This invention relates to structures that can be incorporated into an electrical connector in order to mechanically connect the connector to a complementary component. The structure is particularly applicable to board-to-board connectors, but not limited thereto.

2. Summary of the Prior Art

U.S. Pat. No. 5,324,206 discloses an electrical connector comprising a pressure table floatably coupled to the connector housing and resiliently biased therefrom. This pressure table is operative to bias a flexible circuit against the surface of a mating circuit board.

In electrical connectors, it is necessary to establish not only an electrical connection between the complementary contacts which may be housed in a terminal block or upon a printed circuit board; but also, to interconnect mechanically the mating connector components to ensure that the electrical connection is not defeated. This has been accomplished in the prior art in a number of manners, such as fasteners similar to screws or clips, resilient latch arms on one of the connectors that cooperate with lugs on the other connector, or external devices that function to hold the two together. These structures typically work well where there is a fairly large range of tolerance with respect to where the electrical interconnection may occur over the distance of mating the two connector components together. This would be the case where one of the contacts is a pin contact an the other contact is a receptacle contact having spring arms to form a wiping interconnection with the pin, as anywhere along the pin would form a satisfactory connection. In addition, an interconnection of this type requires that a fairly large load must be brought to bear on the mating connector in order to engage whatever latching structure is being used. These two considerations create a problem where there is either not enough linear travel available to establish the desired interconnection or the mating components are not capable of bearing the amount of force necessary to establish the interconnection. An example might be where a daughter card is to be mated with a mother board and for whatever reason the standard edge card connector is not satisfactory.

These short comings are met by providing an electrical connector according to claim 1 for mating with a complementary component having a mating face and a plurality of complementary contact members. An embodiment of the connector comprising a terminal block having a front face and a plurality of contact receiving regions therein for receiving contacts that mate with the complementary contacts, a housing block wherein the terminal block is disposed and a connector coupler operatively associated with said terminal block for engaging an anchor fixed on the complementary component in order to mechanically couple the connector and complementary component; the connector being characterized in that: the connector is mounted upon the board such that the structure may float in the direction of mating and the terminal block is resiliently biased by a resilient member relative the housing bock such that when the connector coupler is engaged with the anchor, the front face of the terminal block together with the mating face for the complementary component.

This makes this connector coupler device especially useful where it is desired to form the interconnection between a contact pad and a spring contact, such as that used in an interposer. This feature further isolates those forces necessary to hold the electrical connector with the complementary component from the forces associated with the contacting members. Finally, a connector of this type is especially useful for board-to-board interconnections where contact pads may be used instead of contact pins. For example, in U.S. Pat. No. 4,895,521 (incorporated herein by reference for all purposes) a co-axial connection module is disclosed that is particularly suite for board interfaces, especially one disposed on a multi-level board. In this case a signal pad is surrounded by a ground pad such that complete shielding is offered at the board. The module includes a conductive outer sleeve, a dielectric support element and a contact element having a spring portion extending therefrom. The conductive sleeve being configured to engage the ground pad and the spring portion to abut the signal pad such that a true co-axial interconnection is formed. By incorporating modules of this type into a connector having the aforedescribed structure, dimensional variations can be accommodated, mating force requirements reduced and any mechanical set of the spring member minimized as the loading thereof is controlled.

SUMMARY OF THE INVENTION

It is an advantage of this invention that the connector coupler may be engaged to the anchor as the connector and complementary component are being mated so that the spring member establishes the mating forces therebetween. It is another advantage of this invention that by having the contact members of the complementary component a said distance from the mating force and the contacts of the connector a said distance from the front face, electrical connection may be assured in a reliable manner as the mating face will abut the front face, thereby fixing the distance between contacts also.

DETAILED DESCRIPTION OF THE PREFERRED EMBODIMENT

Figure 1:
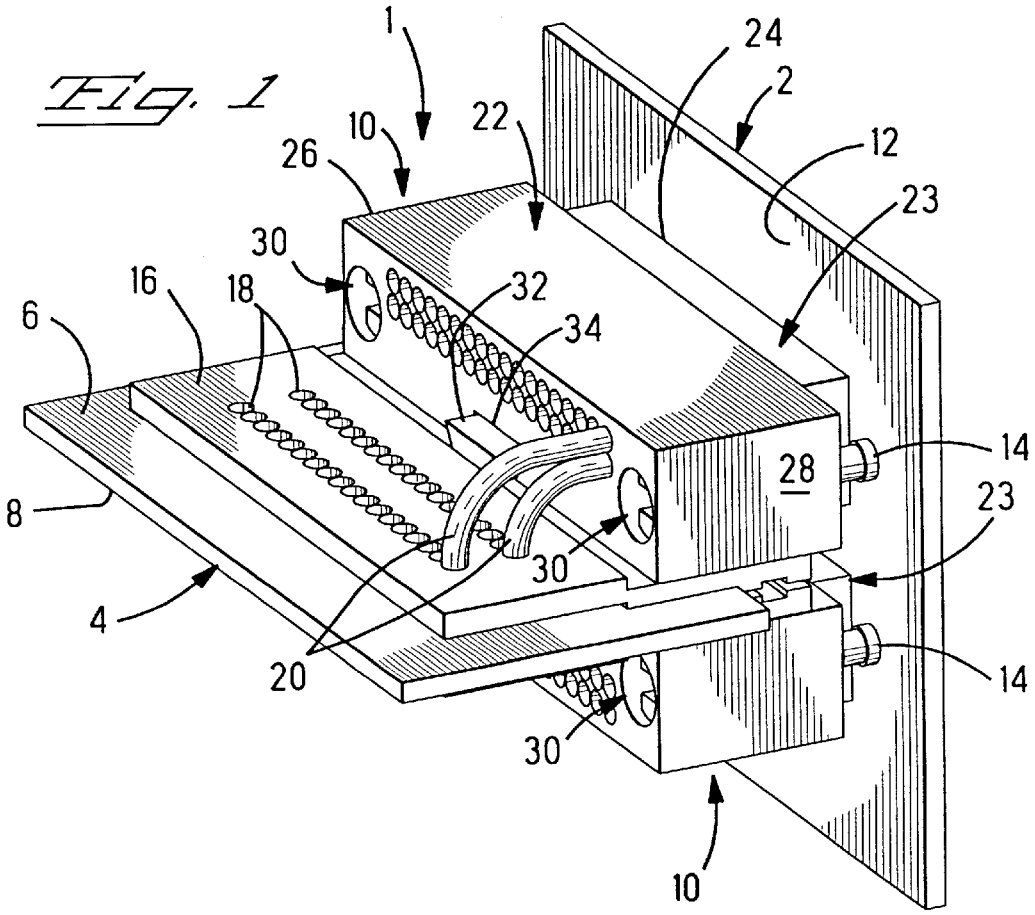
FIG. 1 is an upper rear perspective view of the present invention incorporated into a board-to-board interconnection system.

With reference first to FIG. 1, a board-to-board interconnection is shown generally at 1. The board-to-board interconnection 1 includes a motherboard 2 and a daughter card 4. The daughtercard 4 has upper and lower surfaces 6,8 with electrical connectors 10 that incorporate the present invention therein. It is important to note that the invention is being described with reference to a board-to-board connection system 1 where it is especially advantageous but the invention is not limited to such applications.

The motherboard 2 is a complementary component having a mating face 12 thereupon. As would be typical in printed circuit board construction, the motherboard 2 would include circuit traces and components upon the mating face 12 and a plurality of complementary contact members (not shown) forming an electrical interconnection with the mating component or daughter card 4. The motherboard 2 further includes anchors 14 fixed to and extending therefrom.

With reference still to FIG. 1, the daughtercard 4 carries a pair of connectors 10 that are interconnected on opposite faces 6,8 thereof. In the embodiment shown, each connector 10 is made up of a base plate 16 that lies fixed against the corresponding face 6,8 and includes a plurality of openings 18 for providing access to the contact members (not shown) disposed upon the daughter card 4 by flexible conductor members 20. The conductor members 20 extend from the base plate 16 into a housing block 22 where they are connected to contact modules (not shown). These contact modules may be advantageously formed as interposer-style contacts that rely on a normal force established perpendicularly to the corresponding mating faces 12,24 to establish an electrical interconnection such as those disclosed in U.S. Pat. No. 4,895,521. Another example of an acceptable contact is disclosed in U.S. Pat. No. 5,228,861.

The housing block 22 contains a resiliently biased and floating terminal block 23 that has a front face 24 that can be seen abutting the mating face 12 of the motherboard 2. At each end 26,28 of the housing block 22 are connector couplers 30. The connector couplers 30 will be described in greater detail below. The housing block 22 is slidably affixed to the base 16 by way of complementary dove-tail structure including a male dove-tail 32 as part of the base 16 and a female dove-tail slot 34 as part of the housing block 22. This provides that the housing block 22 with float along the dove-tail strucure 32,34. It may be possible to use other mechanical couplings as an alternative to the dove-tail that limit the motion therebetween to a single degree of freedom. Additionally, the terminal block 23 may be similarly mounted to the base 16 (free floating) upon the dove-tail 32 or coupled only to the housing block 22 through dove-tails formed in the sidewalls thereof. The terminal block 23 has a releasable latch mechanism between the housing block 22 and the terminal block 23 such that they are selectively coupled. Furthermore, a resilient member or spring acts between the block 22,23 to bias the terminal block 23 from the housing block 22 as will be described below. Note, the amount of float of either block 22,23 may be limited by stop or latch structure (not shown) therebetween.

Figure 3:
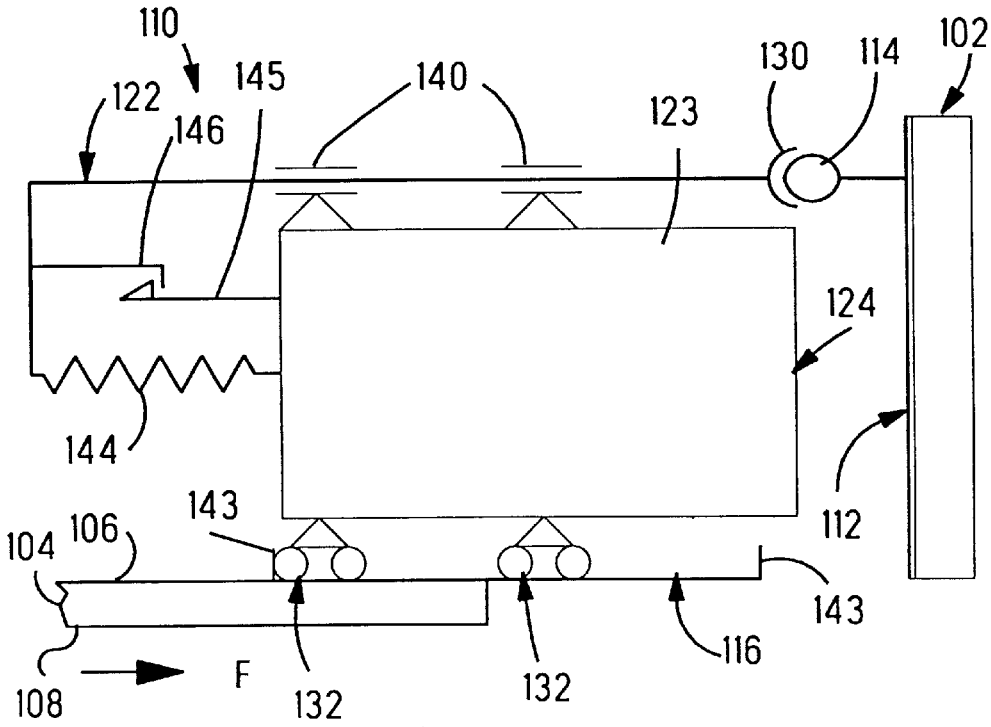
FIG. 3 is a conceptual schematic view similar to FIG. 2 showing the first mated position.
Figure 4:
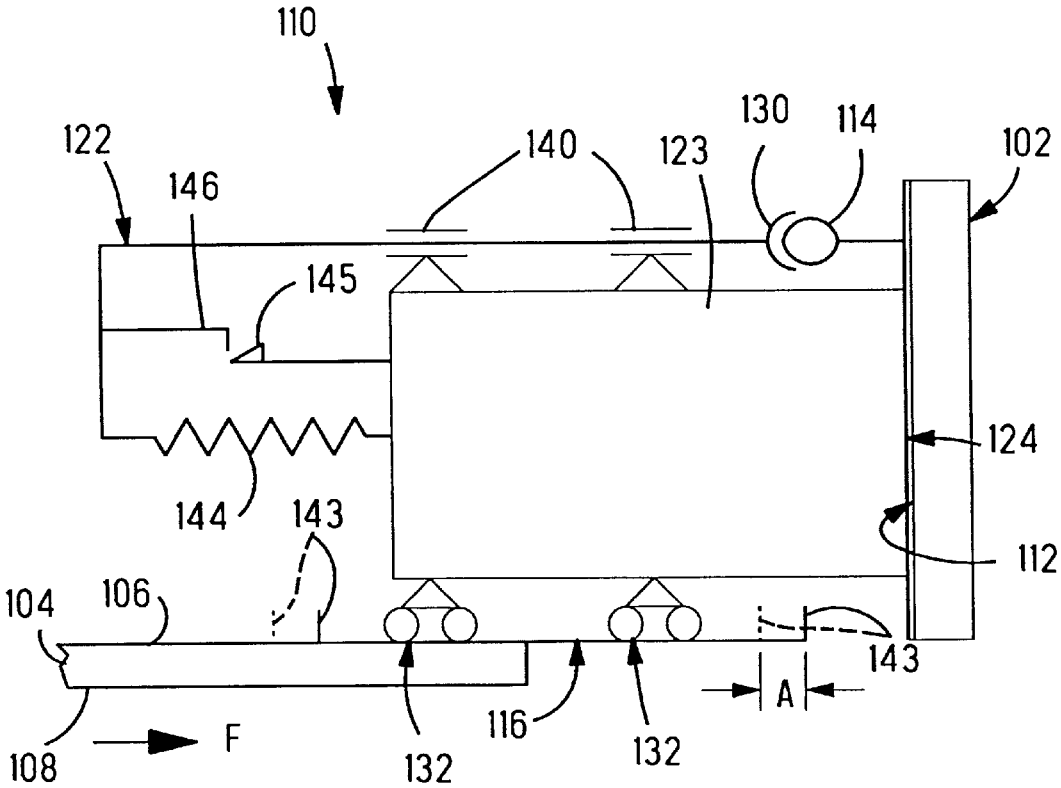
FIG. 4 is a conceptual schematic view similar to FIG. 3 showing the fully mated position.
Figure 5:
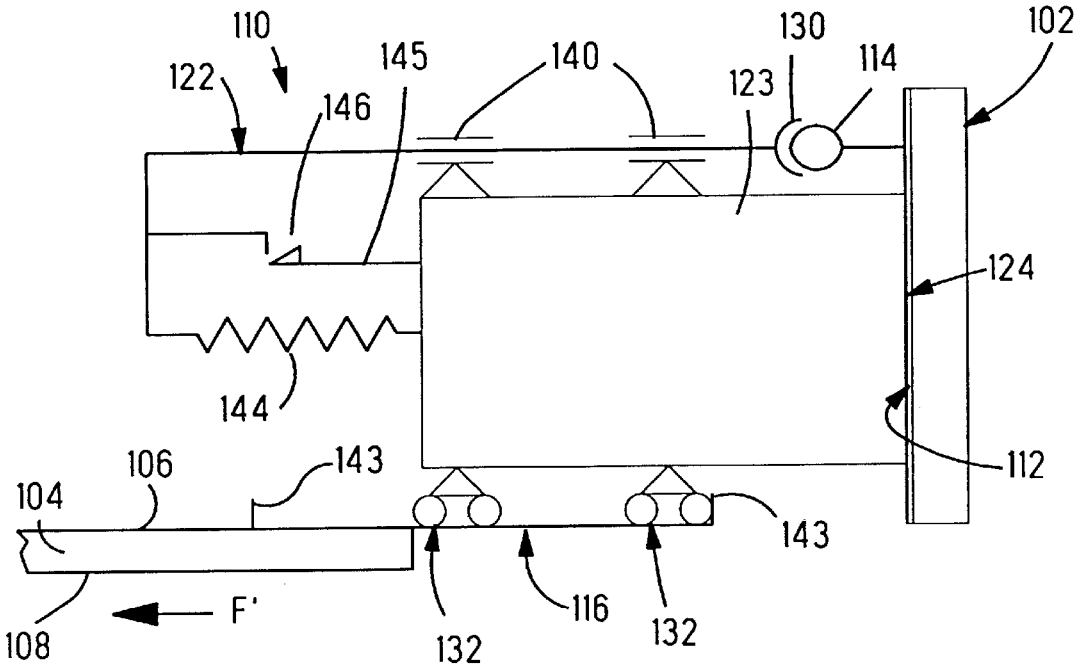
FIG. 5 is a conceptual schematic view showing initial de-mating.
Figure 6:
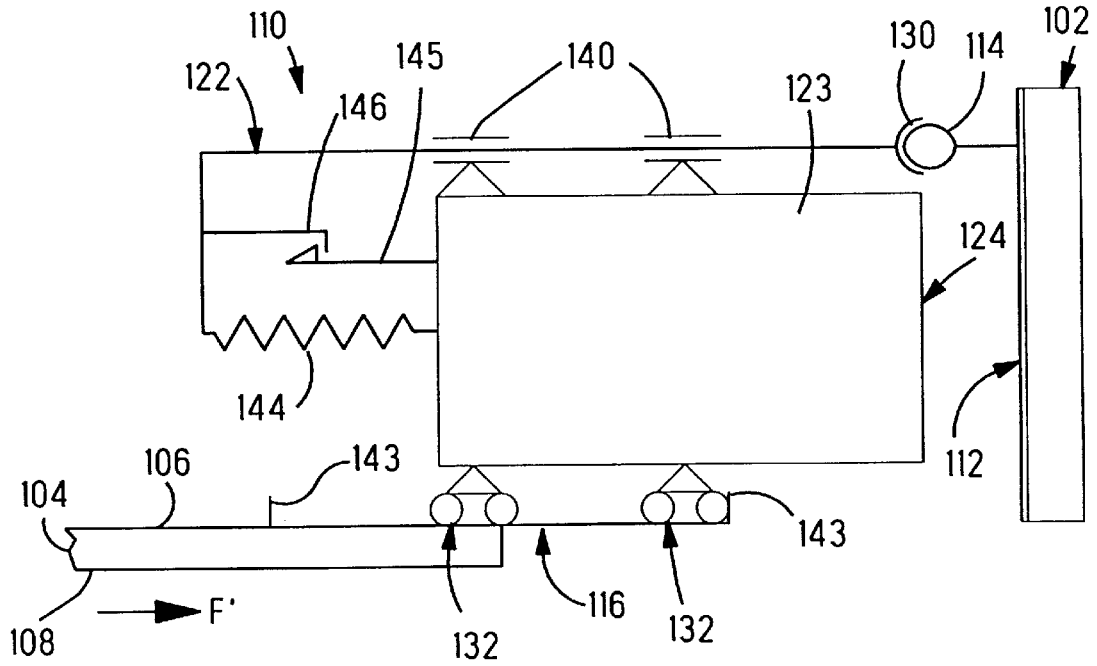
FIG. 6 is a conceptual schematic view showing the first de-mated position that corresponds to the mated condition of FIG. 3.
Figure 7:
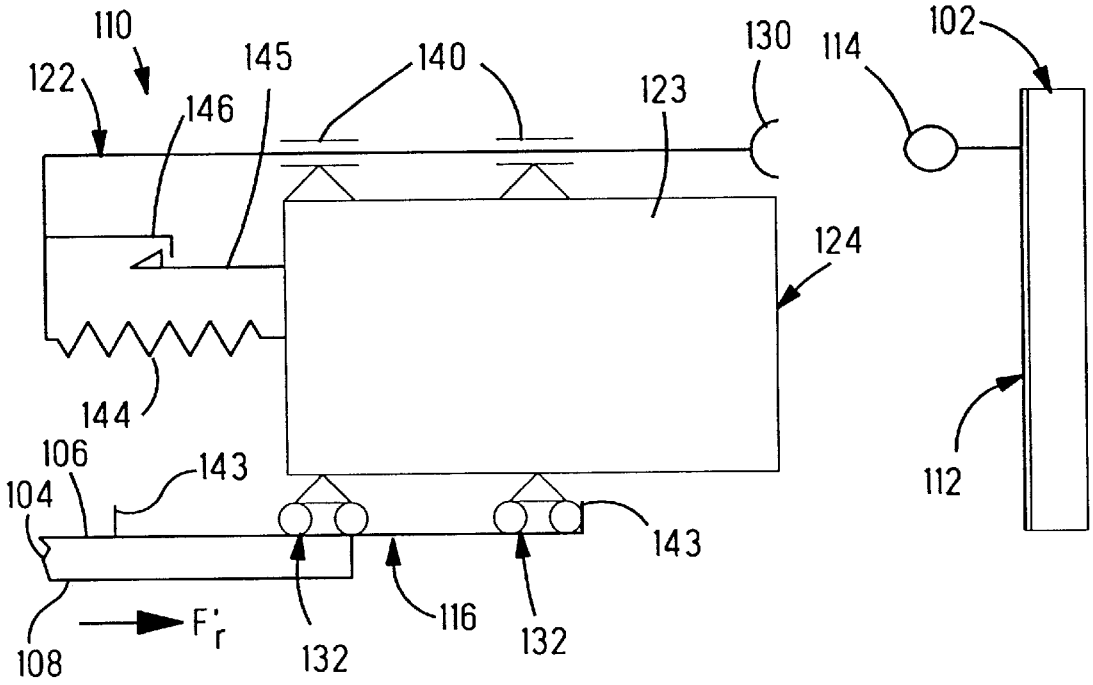
FIG. 7 is a conceptual schematic view showing the fully de-mated position that corresponds to the pre-mated or "cocked" condition of FIG. 2.
Figure 8:
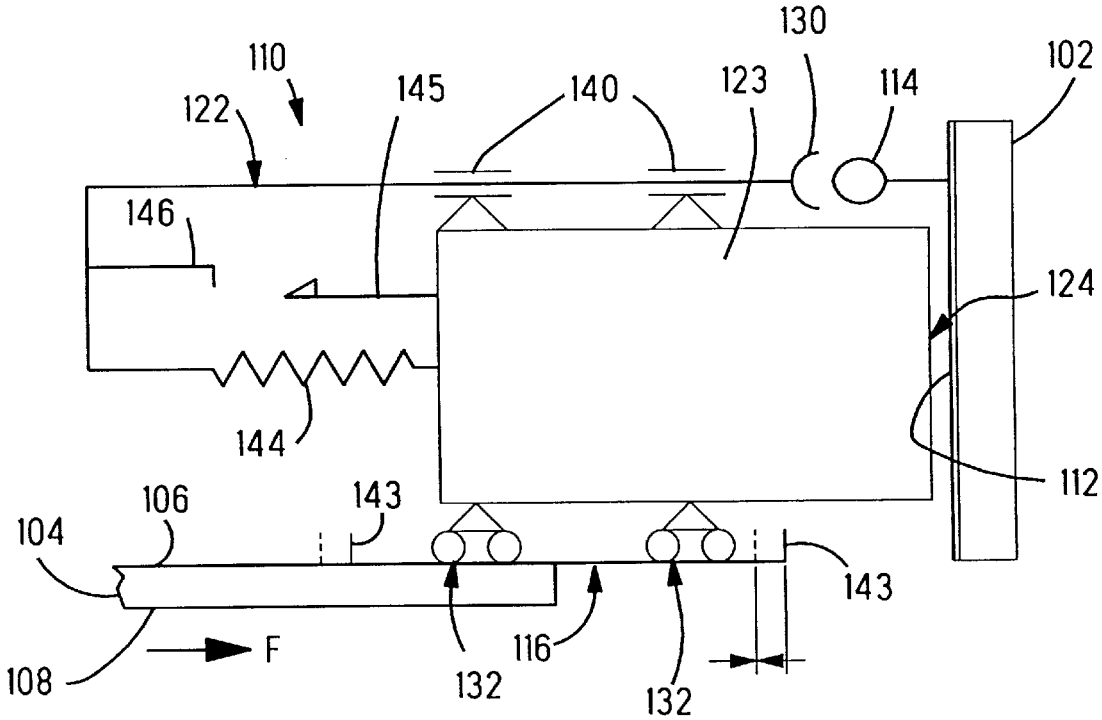
FIG. 8 is a conceptual schematic view showing attempted mating of the connector when not in the pre-mated or "cocked" condition.

The invention is best described with reference to the conceptual schematic views shown in FIGS. 2–8, where FIGS. 2–5 show the mating sequence, FIGS. 5–7 show the demating sequence and FIG. 8 shows a fail safe feature where the connector 10 is prevented from mating unless in a "cocked" position. In these Figures, the representations corresponding to the features described above are numbered in the 100 series in a corresponding manner and the conceptual features, separately, are all within the basic mechanical arts and may be achieved in various ways.

Figure 2:
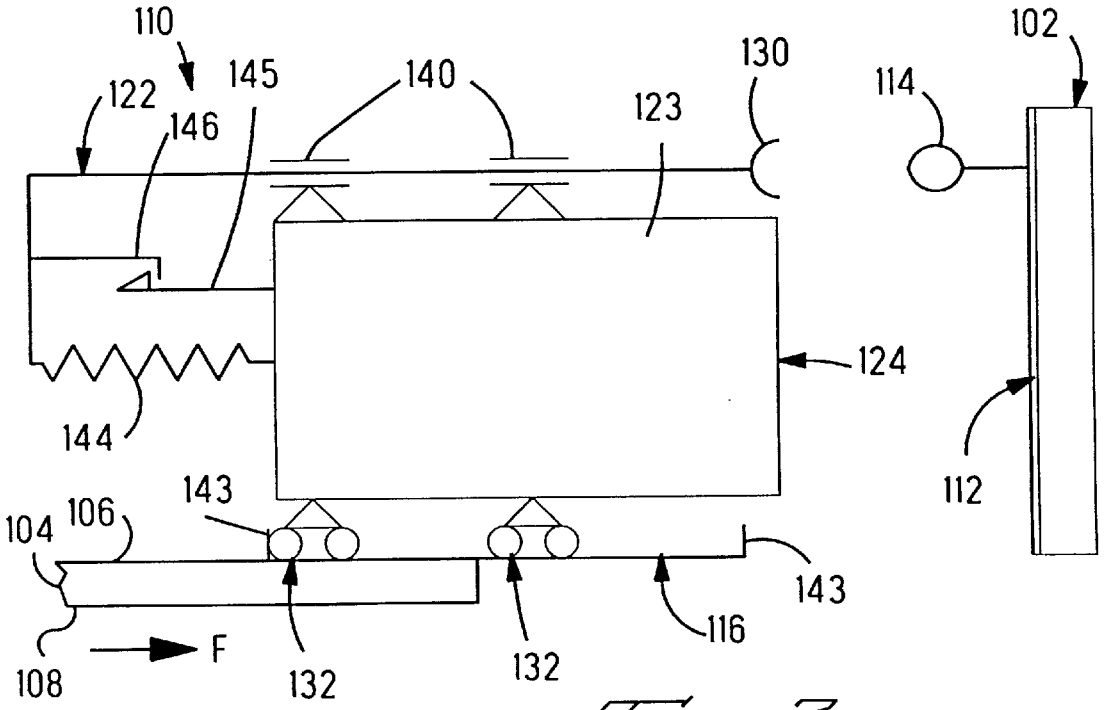
FIG. 2 is a conceptional schematic view of the workings of a board-to-board connector of FIG. 1 showing a pre-mating "cocked" condition.

With reference now to FIG. 2, the connector 110 is mounted upon the daughter card 104 by the base plate 116 with the terminal block 122 disposed within the housing block 22 such that it is free to move longitudinally relative thereto as established by the dove-tails 40. The housing block 22 and the terminal block 23 are slidably coupled relative each other and to the base 116, for example by way of the dove-tails 132 and 140, such that the housing block 122 is free to move axially upon the daughtercard 104 and the terminal block 123 is free to move axially relative the housing block 122 in the direction of insertion F. The base 116 further includes stops 143 that are used to limit the displacement of the terminal block 123 as will be described below. The terminal block 123 and the housing block 122 are joined together by a resilient member 144 and at a releasable latching mechanism consisting of a latch arm 145 and a catch 146 affixed to the terminal block 122 and the housing block 123 respectively. The releasable latching structure may take on any number of forms as are well known in the mechanical arts. Additionally, a connector coupler 130 is attached to the housing block 122 for engaging the anchor 114 of the mother board 102.

With the releasable latch mechanism positioned such that the latch arm 145 is retained by the catch 146, as shown in FIG. 2, the daughter card 104 is inserted in the direction of force F. With reference now to FIG. 3, insertion in the direction force F continues until the coupling member 130 engages the anchor 114. At this engagement point, the face 124 of the terminal block 123 is separated from the face 112 of the motherboard 102. As a result of the stop surface 143 upon the base 116 and the coupled releasable latch mechanism 145,146 sufficient force may be generated to engage the coupling member 130 with the anchor 114. As the coupling member 130 is relatively stiffly joined to the housing block 122, it is not possible for additional force in the direction of arrow F to bring the mating faces 124,112 into engagement.

With reference now to FIG. 4, once the connector is positioned as in FIG. 3, the releasable latch members 145,146 are disengaged, for example by a mechanical feature that separates the coupling, such that the terminal block 123 is disposed such that the mating faces 124,112 are abutting as a result of the resilient member 144. Additionally, a certain amount of manufacturing tolerances in the positioning and the sizes of the components may be accommodated by the variation A. Within this region, it is possible for the resilient member 144 to exert roughly the same amount of force at the mating face interface 124,112. Additionally, in this configuration, there is no force link between the terminal block 123 and the daughter board 104 such that the terminal block 123 is essentially free floating relative thereto and biased against the mother board 102 by the spring force of the resilient member 144 that is coupled to the housing block 122 which is anchored to the mother board 102 by coupling member 130.

With respect now to FIGS. 5–7, the demating sequence will be described. With reference first to FIG. 5, upon the exertion of a removal force F', the daughter card 4 is withdrawn such that the base unit 116 moves relative the terminal block 123 until the front step 143 becomes engaged therewith. Additional displacement in the withdrawal direction F' results in the base member 116 carrying the terminal block 123 rearward until the releasable latch members 145,146 engage (FIG. 6). Upon further extraction in the withdrawal direction F', the coupling member 130 disengages from the anchor 114. In this position, the connector 10 would be ready for mating on the next insertion.

With reference now to FIG. 8, if the "cocked" position of FIG. 7 and FIG. 2 is not established be for mating, the condition shown in FIG. 8 will occur. The lack of engagement between the releasing latch mechanism 145,146 prevents the coupling member 130 from engaging the anchor 114 as the housing block 122 will travel rearward with the terminal block 123 in response to insertion in the direction of arrow F. This "stubbing" of the "non-cocked" connector 110 assures that proper mating forces are established such that the interposer-style contacts in the mating face 124 achieve proper mating with the contact pads 112 of the motherboard 102.

Figure 9:
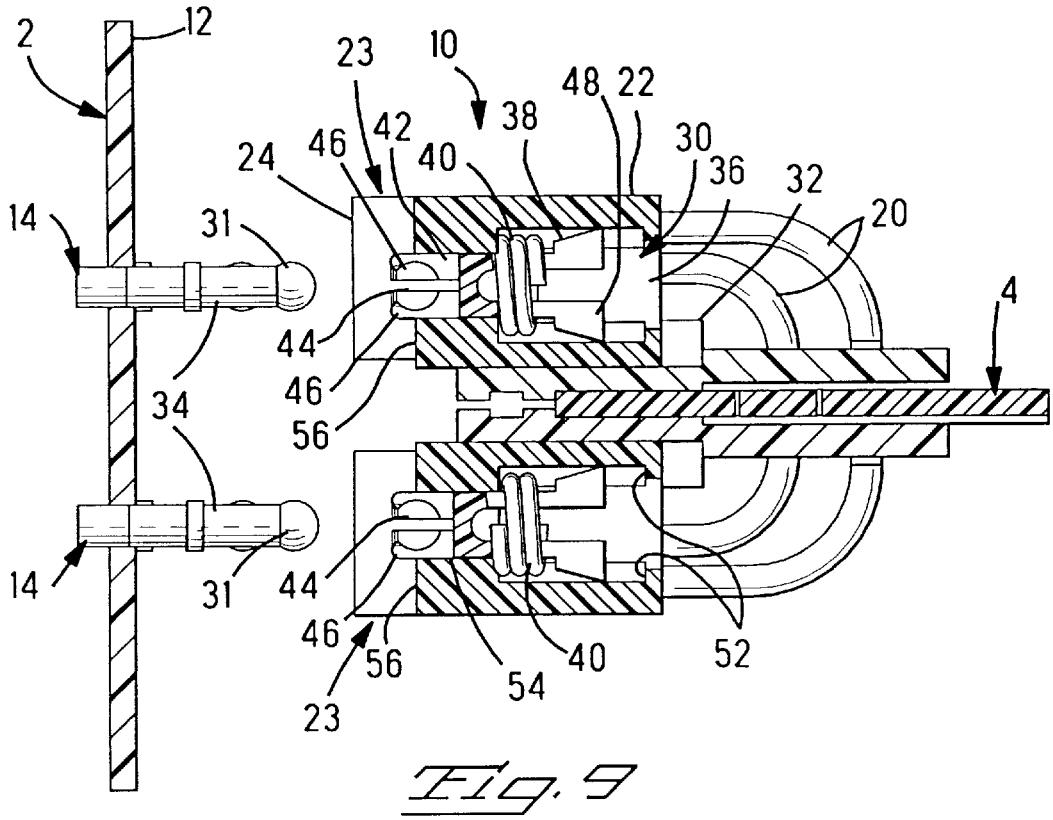
FIG. 9 is a side cross-sectional view corresponding to FIG. 2 showing the electrical connectors of FIG. 1 ready for attachment.
Figure 10:
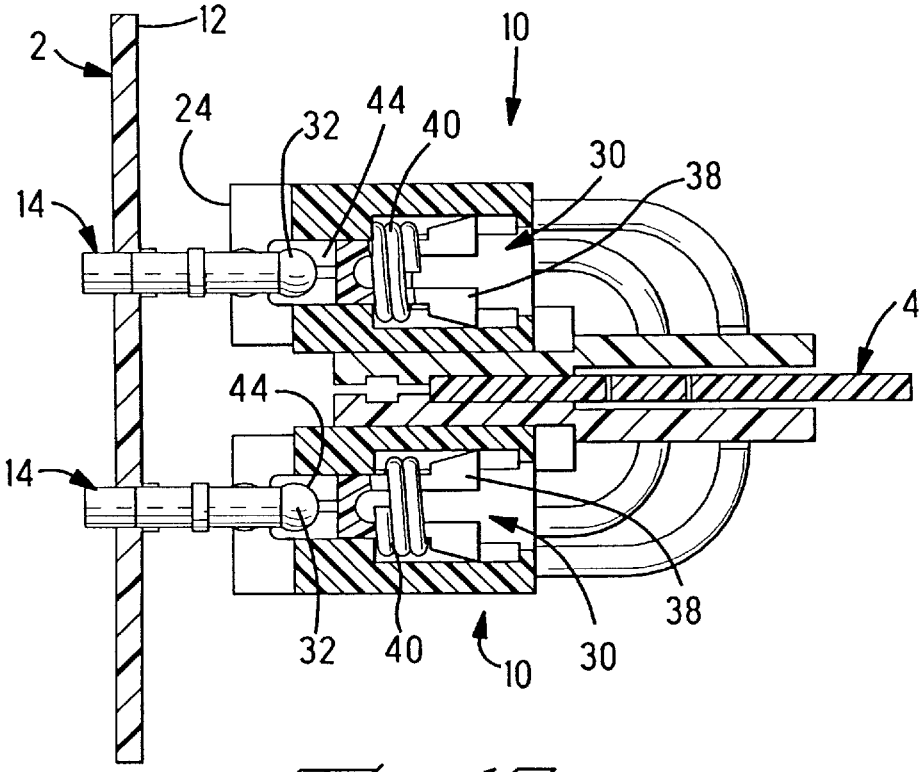
FIG. 10 is a side cross-sectional view corresponding to FIG. 3 showing the connector of FIG. 9 initially coupled to anchors on the mating component.
Figure 11:
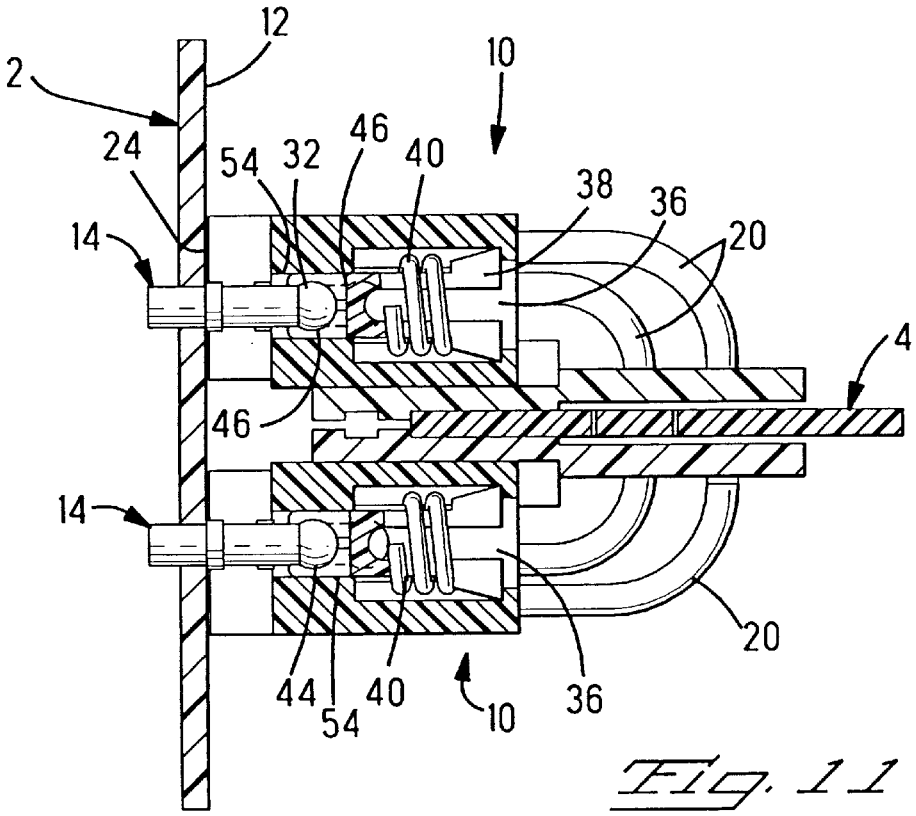
FIG. 11 is a side cross-sectional view corresponding to FIG. 4 showing the connector engaged as in FIG. 1.
Figure 12:
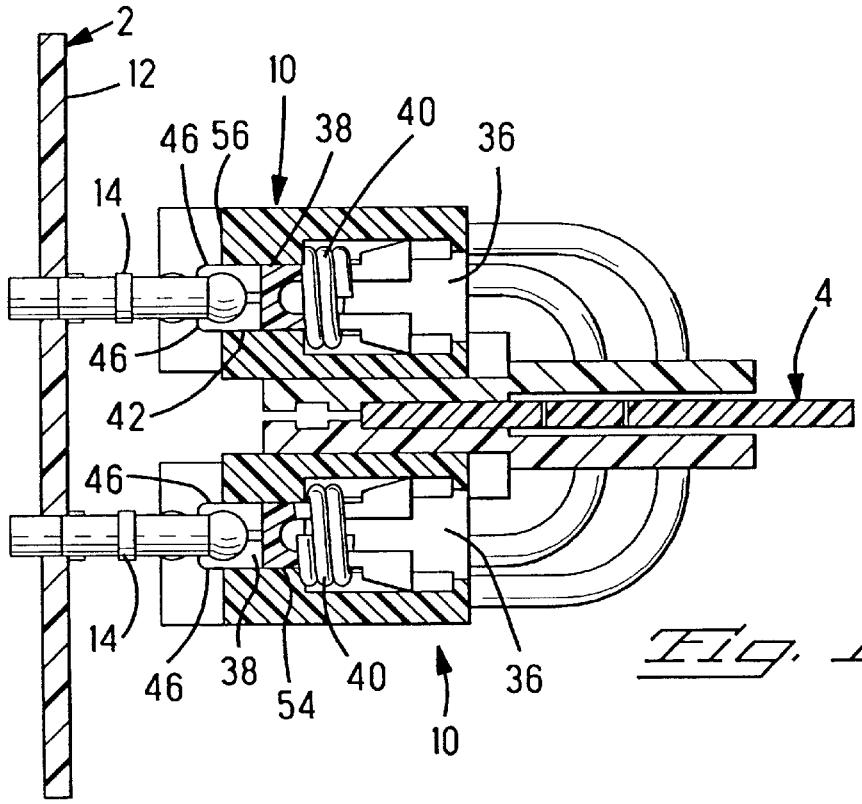
FIG. 12 is a side cross-sectional view corresponding to FIG. 5 showing the connector being disengaged from the anchors on the board.
Figure 13:
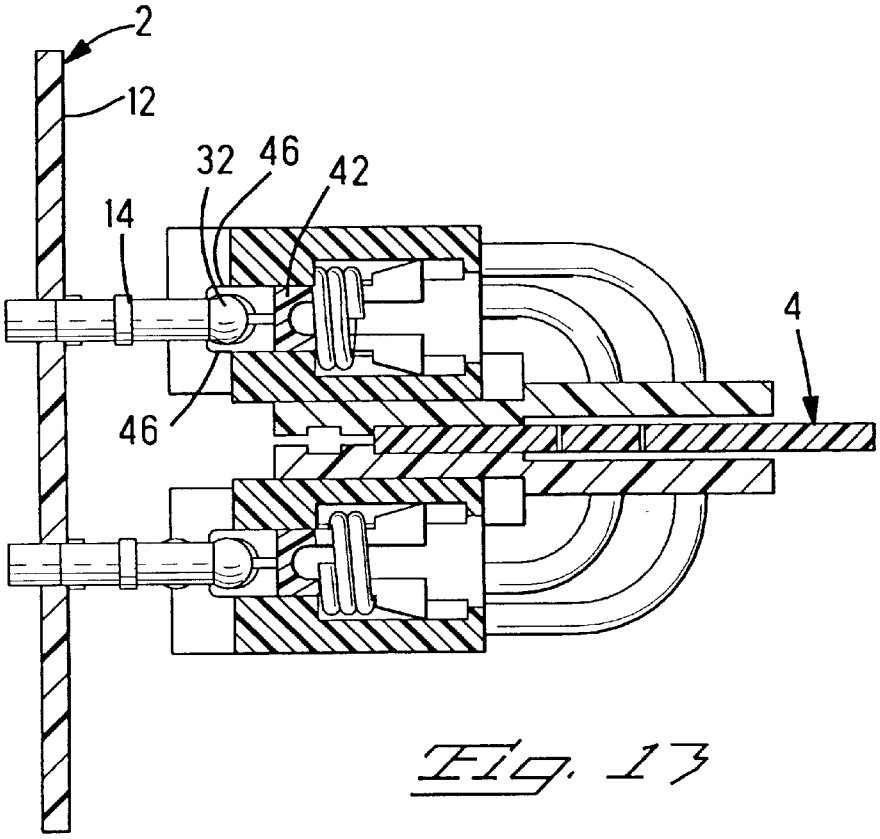
FIG. 13 is a corresponding side cross-sectional view as the anchors disengage from the connector coupling members; and, FIG. 14 shows a side cross-sectional view showing attempted mating where the connector couplers are not in a cocked position.
Figure 14:
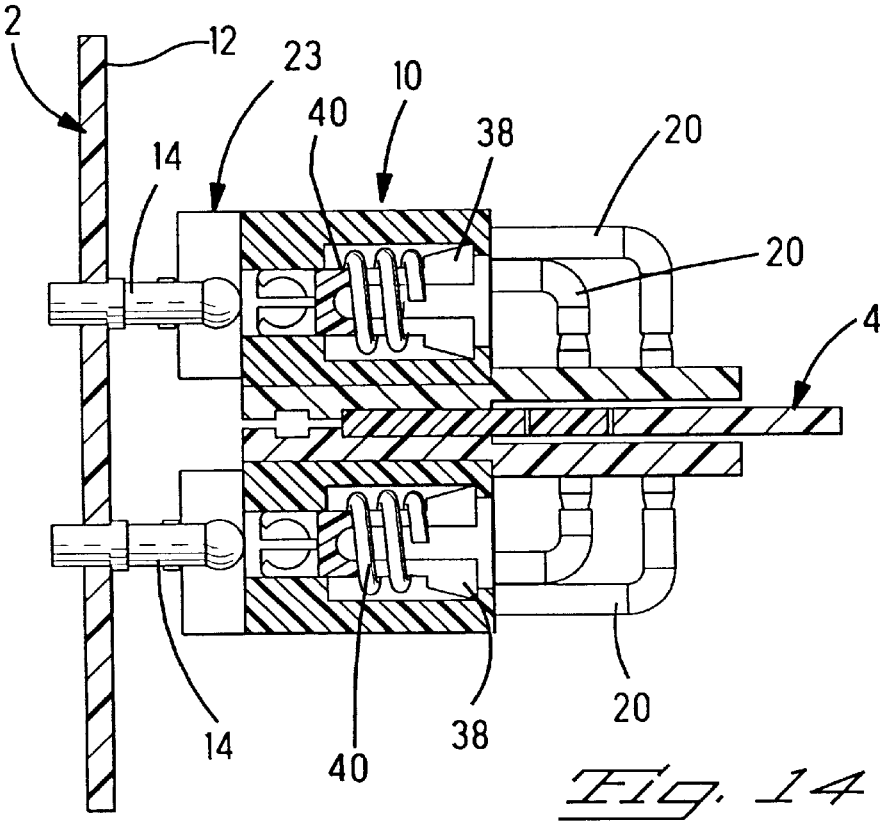

With reference now to FIGS. 9–14, a connector coupling structure and the workings thereof will be described in greater detail. The anchor members 14 that extend from the mating face 12 of the motherboard 2 are mechanically retained therein by conventional means such as soldering or press-fit interference. The anchors 14 include a bulbous head portions 31 generally spherical in shape that extend beyond a pin body 34. With reference now to the connector 10, the connector coupler 30 is disposed within a cavity 36 of the housing block 22 and includes a coupling member 38 operatively connected to the housing block 22 by a resilient member 40 which, in this example, is a simple coil spring. The coupler 38 includes a forward section 42 having a receptacle region 44 configured to generally correspond to the head 31 of the anchor 14. The forward portion 42 is divided into multiple resilient fingers 46 that are deflectable to enable the head 32 to enter the receptacle 44. Opposite the forward portion 42 is a rearward section 48 having multiple resilient arms 48. The resilient arms 48 enable the coupler 38 to be pressed into the cavity 36 and then retained beneath a shoulder 52. The cavity 36 further includes a front portion 54 wherein the forward portion 42 of the coupler 38 is received. The coupler 38 is slidable within the cavity 36 between a position (as shown in FIG. 9) where the coil spring 40 is fully compressed and a relaxed position where the rear portions 40 abut the shoulder 52 (FIGS. 11 and 14).

With further reference to FIG. 9, the electrical connectors 10 are shown with the terminal block 23 biased forward along the dove-tail 32 and the coupler members 38 biased forward within the cavity 36 so that the forward end 42 of the coupler 30 is extending from a stepped face 56 of the housing block 22. In this position, the resilient fingers 46 of the front end 42 of the coupling member 38 are free from the forward portion 54 of the cavity 36 and may deflect outward so that the head 31 may enter the receptacle 44. Once the head 31 is in the receptacle 44, the spring force of the coil spring 40 may be released and the arms 46 may return into the cavity 36 with the head 31 retained therein, as best shown in FIG. 11. Various mechanical structures may be used to effect the release, such as a release button coupled thereto or a ball-point pen push release.

With reference now to FIG. 10, as may be observed, the daughterboard 4 and the associated connectors 10 have been initially fixed to the motherboard 2. In the case the heads 31 of the anchors 14 are engaged within the receptacle portion 44 of the couplers 38. Due to the force exerted by the coil springs 40, the coupling members 38 are gradually being drawn back as the daughterboard 4 moves forward towards the motherboard 2. Provided the components are properly configured and dimensioned, the front face 24 of the terminal block 23 abuts the mating face 12 of the motherboard 2 upon release of the latch mechanism 45,46. This may be best seen in FIG. 11. The terminal block 23 and housing block 22 having coupler members 30 therein are also resiliently coupled.

With reference now to FIG. 11, the connector 10 on the daughterboard 4 has been brought into a fully mated position with the motherboard 2 such that the front face 24 is against the mating face 12. In this position, the head 32 of the anchor 14 is within the receptacle 44 and the fingers 46 of the front end 42 are fully retracted within the forward portion 54 of the cavity 36, thereby the fingers 46 are prevented from expanding by the close fit within the forward portion 54. The cooperation of the forward portion 54 and fingers 46 assure that the connector coupler 30 remains engaged with the anchor 14. Also, the force which the connector face 24 abuts the mating face 12 of the motherboard 2 is directly related to the spring members 40 and where used, the resilient member 44 as shown in FIGS. 2–8. As may be further imagined, it is easy to see that the spring members 40 may be used to draw the two components 2,4 together without the need to exert an insertion force against the motherboard 2 as the daughter card 4 is being mated therewith.

With reference now to FIGS. 12 and 13, removal of the daughter card 4 from the motherboard 2 will be described. By exerting a force on the daughtercard 4 in the direction arrow F' of FIG. 6, the force exerted by the springs 40 is overcome. In doing so, the outer housing 22 of the connectors 10 will be pulled away from the motherboard 2 and the couplers 38 will remain affixed to the anchors 14 until the forward end 42, and in particular the resilient fingers 46, pass the face 56 so that they are free of the forward portion 54 of the cavity 36. At this point the couplers 38 are retained in the cavity 36 in the cocked position of FIG. 9. Further exertion of the force will result in the resilient fingers 46 opening about the head 31 of the anchor 14 and releasing therefrom. As shown in FIG. 13, the coupler 38 will then be pulled back by spring member 40 and the daughtercard 4 will be free from the motherboard 2. With reference to FIG. 14, unless the couplers 38 are in the cocked position of FIG. 9, it will not be possible to engage the anchors 14. This provides a similar "stubbing" to that described above.

Initially, a special tool could be brought against the coupler members 38 to bias them forward into the position shown in FIG. 9. The couplers 138 would then be locked in this position.

While the afore going has been described generally with respect to a board-to-board interconnection 1, it should be apparent that the general principles of the anchor 14 and the coupling mechanism to isolate forces could be transferred to other connector applications. In addition, while particular contact structure has not been described in detail it should be apparent that numerous designs would be acceptable, including the afore mentioned "interposer" style interconnection where a spring member contact is biased against a contact pad without mechanically embracing the pad. Advantageously, for high performance, each signal contact is surrounded by a ground contact. Furthermore, while the jumpers 20 have been shown entering from the rear of the terminal block 23 above, it may also be possible to utilize side entry.

We claim:

1. An electrical connector for mating with a complementary component having a mating face and an anchor, the connector comprises a connector housing having a connector coupler therein for engaging the anchor in a fixed manner and a terminal block for receiving individual contact modules, with resilient contacts, therein and arranged complementarily to the mating face, wherein the terminal block is floatably coupled to the connector housing and resiliently biased therefrom by a resilient member such that the coupling force at the mating face is determined by the force of the resilient member.

2. The connector of claim 1, wherein the connector housing and terminal block include a releasable latch therebetween such that the terminal block is held back from the mating face until the coupler engages the anchor.

3. The connector of claim 1, wherein the connector housing is floatably mounted on a substrate such that when the substrate and the complementary component are mated, the mating force at the complementary component is determined by the resilient member relatively independent of the position of the substrate relative the complementary component.

4. The connector of claim 2, wherein the connector housing and the terminal block must be latched together in order for the coupler to engage the anchor such that the mating occurs, thereby preventing pushback or stubbing.

5. The connector of claim 3, wherein the coupler is spring loaded.

6. The connector of claim 4, wherein the latch is re-engaged upon demating.

7. An electrical connector for mounting to a first board to establish an interconnection to a second board having a mating face thereupon, where an anchor is provided for positioning the electrical connector relative the second board, the electrical connector comprising:

a connector housing attachable to the first board, including a base plate to be positioned in the vicinity of the first board and including a plurality of openings for providing access to contact members on the first board; a floating terminal block for carrying a plurality of individually resilient contacts that rely on normal forces established perpendicularly to the mating face to establish an electrical connection with the mating face of the second board, flexible conductors extending between the base plate and the terminal block to the establish the electrical connection between the first board and the second board; and, a biasing member positioned relative the housing and the terminal block so that the terminal block is biased away from the housing, the biasing member exerting a spring force on the terminal block such that a mating force is established; and a coupler for engaging the anchor in a fixed manner.

8. The electrical connector of claim 7, wherein the biasing member is a coil spring.

9. The electrical connector of claim 8, wherein the positioning of the electrical connector relative the mating face of the second board is determined by a pin-and-socket structure incorporated into the connector and the second board.

10. The electrical connector of claim 9, wherein the anchor and the coupler are also the pin-and-socket structure.

11. The electrical connector of claim 7, wherein when the anchor and the coupler are engaged, the biasing member causes a mating force to be exerted on the terminal block and through to the mating face of the second board, the mating force being relatively independent of the positioning of the electrical connector and the second board.

12. An electrical connector for interconnecting a first circuit board to a second circuit board where the connector is adapted to be mounted to the first circuit board and the second circuit board is provided with an anchor, the electrical connector comprising:

a connector housing attachable to the first board, including a base plate to be positioned in the vicinity of the first board and including a plurality of openings for providing access to contact members on the first board; a floating terminal block cooperating with a plurality of individually resilient contacts that rely on normal forces established perpendicularly to the mating face to establish an electrical connection with the mating face of the second board, flexible conductors extending between the base plate and the electrical contacts to establish an electrical connection between the first board and the second board; a biasing member positioned relative the housing and the terminal block so that the terminal block, and the plurality of individually resilient contact elements are biased away from the housing, the biasing member exerting a spring force on the terminal block such that a mating force is established between the contacts and the second circuit board is established; and, a coupler for engaging the anchor in a fixed manner.

* * * * *